US012520875B2

(12) United States Patent
Sayed et al.

(10) Patent No.: US 12,520,875 B2
(45) Date of Patent: Jan. 13, 2026

(54) AEROSOL PROVISION DEVICE

(71) Applicant: Nicoventures Trading Limited, London (GB)

(72) Inventors: Ashley John Sayed, London (GB); Mitchel Thorsen, Madison, WI (US); Luke James Warren, London (GB)

(73) Assignee: Nicoventures Trading Limited, London (GB)

( * ) Notice: Subject to any disclaimer, the term of this patent is extended or adjusted under 35 U.S.C. 154(b) by 585 days.

(21) Appl. No.: 17/438,287

(22) PCT Filed: Mar. 9, 2020

(86) PCT No.: PCT/EP2020/056249

§ 371 (c)(1),
(2) Date: Sep. 10, 2021

(87) PCT Pub. No.: WO2020/182757

PCT Pub. Date: Sep. 17, 2020

(65) Prior Publication Data

US 2022/0142255 A1 May 12, 2022

Related U.S. Application Data

(60) Provisional application No. 62/816,331, filed on Mar. 11, 2019, provisional application No. 62/816,332, filed on Mar. 11, 2019.

(51) Int. Cl.
*A24F 40/465* (2020.01)
*A24F 40/42* (2020.01)

(52) U.S. Cl.
CPC ..... *A24F 40/465* (2020.01); *A24F 40/42* (2020.01)

(58) Field of Classification Search
CPC ..... A24F 40/465; A24F 40/42; A24F 40/20; A24F 40/70; A24F 40/40; A24F 40/46; A24F 40/50; A24F 40/51; A24D 1/20
(Continued)

(56) References Cited

U.S. PATENT DOCUMENTS 3,144,975 A 8/1964 Turnage et al.
5,989,196 A 11/1999 Chu et al.
(Continued)

FOREIGN PATENT DOCUMENTS

CA 3017429 12/2017
CN 102060268 5/2011
(Continued)

OTHER PUBLICATIONS

International Search Report and Written Opinion for International Application No. PCT/EP 2020/056249, dated Sep. 8, 2020, 21 pages.

(Continued)

*Primary Examiner* — Peter G Leigh
(74) *Attorney, Agent, or Firm* — Merchant & Gould P.C.

(57) ABSTRACT

Aerosol provision devices comprising a heater component are disclosed. In one device, the heater component (132) comprises a first portion (202) having a first outer cross section and a second portion (204) having a second outer cross section. The device further comprises a support (136) comprising a receptacle (210) engaged with the second portion of the heater component to hold the heater component. The receptacle has an inner cross section corresponding to the second outer cross section of the heater component to prevent rotation of the heater component relative to the support.

20 Claims, 12 Drawing Sheets

(58) Field of Classification Search
USPC ..... 131/329
See application file for complete search history.

(56) References Cited

U.S. PATENT DOCUMENTS

| | | | | |
|---|---|---|---|---|
| 6,287,118 | B1 | 9/2001 | Naganuma et al. | |
| 10,181,677 | B2 * | 1/2019 | Vassgård | H01R 13/523 |
| 11,103,006 | B1 * | 8/2021 | Zhang | A24F 40/60 |
| 11,259,571 | B2 * | 3/2022 | Lee | A61M 15/06 |
| 11,980,228 | B2 * | 5/2024 | Widmer | B29C 45/14336 |
| 2011/0155153 | A1 | 6/2011 | Thorens et al. | |
| 2014/0261495 | A1 * | 9/2014 | Novak, III | H05B 3/00 392/386 |
| 2014/0345634 | A1 | 11/2014 | Zuber et al. | |
| 2014/0373856 | A1 | 12/2014 | Zuber et al. | |
| 2015/0223522 | A1 | 8/2015 | Ampolini et al. | |
| 2016/0095356 | A1 * | 4/2016 | Chan | A24F 40/30 392/390 |
| 2017/0055583 | A1 * | 3/2017 | Blandino | A24D 1/20 |
| 2017/0079326 | A1 | 3/2017 | Mironov | |
| 2017/0340014 | A1 * | 11/2017 | Batista | A24F 40/485 |
| 2018/0020736 | A1 * | 1/2018 | Silvestrini | F22B 1/284 131/329 |
| 2018/0020737 | A1 * | 1/2018 | Mironov | F16T 1/00 131/329 |
| 2018/0070641 | A1 * | 3/2018 | Batista | A24F 40/50 |
| 2018/0110940 | A1 | 4/2018 | Suzuki et al. | |
| 2018/0140017 | A1 * | 5/2018 | Qiu | H05B 3/03 |
| 2018/0168228 | A1 * | 6/2018 | Reevell | A24F 40/48 |
| 2018/0175542 | A1 * | 6/2018 | Williams | H01R 13/631 |
| 2018/0338531 | A1 * | 11/2018 | Reevell | A24F 40/40 |
| 2018/0360130 | A1 | 12/2018 | Bowen et al. | |
| 2018/0368478 | A1 * | 12/2018 | Golovanova | A24F 40/485 |
| 2020/0154768 | A1 * | 5/2020 | Han | H05B 3/06 |
| 2020/0170298 | A1 * | 6/2020 | Lee | A24F 40/46 |
| 2023/0352872 | A1 * | 11/2023 | Hommedal | H01R 13/523 |

FOREIGN PATENT DOCUMENTS

| | | | |
|---|---|---|---|
| CN | 203424295 | | 2/2014 |
| CN | 203441922 | | 2/2014 |
| CN | 203659946 | | 6/2014 |
| CN | 203841115 | | 9/2014 |
| CN | 104135880 | | 11/2014 |
| CN | 204232278 | | 4/2015 |
| CN | 204610494 | | 9/2015 |
| CN | 205597118 | U | 9/2016 |
| CN | 106595370 | | 4/2017 |
| CN | 106617324 | | 5/2017 |
| CN | 106998815 | | 8/2017 |
| CN | 206852035 | | 1/2018 |
| CN | 108308708 | | 7/2018 |
| CN | 108338419 | A | 7/2018 |
| CN | 108354230 | A | 8/2018 |
| CN | 108617042 | A | 10/2018 |
| CN | 108667097 | | 10/2018 |
| CN | 108667097 | A | 10/2018 |
| CN | 208096024 | | 11/2018 |
| CN | 109068740 | | 12/2018 |
| CN | 109077363 | | 12/2018 |
| CN | 109330030 | A | 2/2019 |
| EP | 3 610 740 | A2 | 2/2020 |
| JP | 1995279939 | | 10/1996 |
| JP | 1997122714 | | 5/1997 |
| JP | H1167424 | A | 3/1999 |
| JP | 2002328735 | A | 11/2002 |
| JP | 2007267749 | | 10/2007 |
| JP | 2015205148 | | 11/2015 |
| JP | 2016534730 | | 11/2016 |
| JP | 2018023186 | A | 2/2018 |
| JP | 2018078912 | A | 5/2018 |
| JP | 2018174784 | A | 11/2018 |
| JP | 7432286 | | 2/2024 |
| KR | 10-2019-0015224 | | 2/2019 |
| KR | 20190019118 | | 2/2019 |
| RU | 2611487 | C2 | 2/2017 |
| WO | 2013034458 | A1 | 3/2013 |
| WO | 2016101143 | | 6/2016 |
| WO | 2017075759 | | 5/2017 |
| WO | 2018002083 | A1 | 1/2018 |
| WO | 2018002086 | A1 | 1/2018 |
| WO | 2018007965 | | 1/2018 |
| WO | 2018180758 | A1 | 10/2018 |
| WO | WO 2018/190603 | | 10/2018 |
| WO | WO 2018/190607 | | 10/2018 |
| WO | 2020180126 | | 9/2020 |

OTHER PUBLICATIONS

"Decision of Refusal received for Japanese Patent Application No. 2021-554594, mailed on Apr. 18, 2023", 12 pages (6 pages of English Translation and 6 pages of Official Copy).
"International Preliminary Report on Patentability received for PCT Patent Application No. PCT/EP2020/056249, mailed on Sep. 23, 2021", 14 pages.
"Invitation to Pay Additional Fees received for PCT Patent Application No. PCT/EP2020/056249, mailed on Jul. 15, 2018", 14 pages.
"Notice of Reason for Refusal received for Japanese Patent Application No. 2021554594, mailed on Nov. 8, 2022", 16 pages (8 pages of English Translation and 8 pages of Official Copy).
"Office Action and Search Report received for Russian Application No. 2021126509, dated Oct. 18, 2022", 9 pages.
"Office Action received for Chinese Patent Application No. 202080035037.1, mailed on Jun. 28, 2023", 11 pages (7 pages of English Translation and 4 pages of Official copy).
"Office Action received for Korean Patent Application No. 10-2021-7028930, mailed on Sep. 19, 2023", 10 pages (5 pages of English Translation and 5 pages of Official Copy).
"Reasons for Refusal received for Japanese Patent Application No. 2023-133374, mailed on Aug. 20, 2024", 2 pages (English Translation Only).
"Office Action received for Chinese Patent Application No. 202080035037.1, mailed on May 27, 2024", 8 pages (English Translation only).
Daxian, Mechanical Design Manual, vol. 2, Chemical Industry Press, 2016, 32 pages.
Hongwen, Mechanics of Materials I, Higher Education Press, 2017, 9 pages.
Hongwen, Mechanics of Materials II, Higher Education Press, 2017, 8 pages.
Jimir, Mechanical Connection Design Examples and Analysis, Machinery Industry Press, 2010, 13 pages.
Shaobian , Anti-fatigue Design Manual, Machinery Industry Press, 2015, 10 pages.
European Office Action for European Patent Application No. 20714866.9 dated Mar. 1, 2025, 27 pages.
Malaysia Office Action for Malaysian Patent Application No. PI2021005140 dated May 28, 2025, 4 pages.
Reason for Refusal for Japanese Patent Application No. 2023-133374, dated Mar. 11, 2025, 15 pages (8 pages translation, 7 pages original).
Reason for Refusal for Japanese Patent Application No. 2023-133374, dated Jun. 24, 2025, 8 pages (4 pages translation, 4 pages original).
Korean Notice of Allowance for Korean Patent Application No. 10-2024-7023257 dated Aug. 8, 2025, 4 pages (1 page translation, 3 pages original).
Chinese Request for Invalidation for Chinese Patent Application No. 2020800350371 dated Dec. 1, 2024, 129 pages (translation).

* cited by examiner

AEROSOL PROVISION DEVICE

CROSS-REFERENCE TO RELATED APPLICATIONS

This application is a National Phase entry of PCT Application No. PCT/EP2020/056249, filed Mar. 9, 2020, which application claims the benefit of U.S. Provisional Application No. 62/816,331, filed Mar. 11, 2019 and U.S. Provisional Application No. 62/816,332, filed Mar. 11, 2019, the entire disclosures of which are incorporated herein by reference.

TECHNICAL FIELD

The present disclosure relates to an aerosol provision device, a method of manufacturing a heater component for an aerosol provision device, a heater component, a support for a heater component and an end member.

BACKGROUND

Smoking articles such as cigarettes, cigars and the like burn tobacco during use to create tobacco smoke. Attempts have been made to provide alternatives to these articles that burn tobacco by creating products that release compounds without burning. Examples of such products are heating devices which release compounds by heating, but not burning, the material. The material may be for example tobacco or other non-tobacco products, which may or may not contain nicotine.

SUMMARY

According to a first aspect of the present disclosure, there is provided an aerosol provision device, comprising:

a heater component, comprising:

a first portion having a first outer cross section; and a second portion having a second outer cross section; and a support, comprising:

a receptacle engaged with the second portion of the heater component to hold the heater component, wherein the receptacle has an inner cross section corresponding to the second outer cross section of the heater component, thereby to prevent rotation of the heater component relative to the support.

According to a second aspect of the present disclosure, there is provided a heater component for an aerosol provision device, comprising:

a first portion having a first outer cross section that is circular in shape; and a second portion having a second outer cross section that is non-circular in shape.

According to a third aspect of the present disclosure, there is provided a support for a heater component of an aerosol provision device, wherein the support defines a receptacle to receive the heater component, wherein the receptacle has an inner cross section that is non-circular in shape.

According to a fourth aspect of the present disclosure, there is provided an aerosol provision device comprising a heater component according to the second aspect and a support according to the third aspect engaged with the heater component.

According to a fifth aspect of the present disclosure, there is provided a method of manufacturing a heater component for an aerosol provision device, the method comprising:

providing a cylindrical heater component having an outer cross section that is circular in shape; and deforming the heater component such that an outer cross section of a portion of the heater component is non-circular.

According to a sixth aspect of the present disclosure, there is provided a heater component for an aerosol provision device, wherein a portion of the heater component is keyed to prevent rotation of the heater component within a receptacle of the aerosol provision device.

According to a seventh aspect of the present disclosure, there is provided a support for a heater component of an aerosol provision device, wherein the support comprises a receptacle to receive the heater component, wherein the receptacle is keyed to prevent rotation of the heater component within the receptacle.

According to an eighth aspect of the present disclosure, there is provided an aerosol provision device, comprising:

a heater component;

a support configured to engage the heater component to hold the heater component; and an end member, wherein the end member defines a receptacle and the support is at least partially received within the receptacle;

wherein the support comprises a first locking feature engaged with a second locking feature of the end member, thereby to prevent rotation of the support relative to the end member.

According to a ninth aspect of the present disclosure, there is provided a support for a heater component of an aerosol provision device, wherein:

the support is configured to engage the heater component to hold the heater component;

the support is configured to be received with a receptacle of an end member of the device; and the support comprises a first locking feature configured to engage a second locking feature of the end member.

According to a tenth aspect of the present disclosure, there is provided an end member for an aerosol provision device, wherein:

the end member defines a receptacle configured to receive a support for a heater component of the device; and the end member comprises a locking feature configured to engage a corresponding locking feature of the support.

According to an eleventh aspect of the present disclosure, there is provided a support for a heater component of an aerosol provision device, wherein a portion of the support is keyed to prevent rotation of the support within an end member of the device.

According to a twelfth aspect of the present disclosure, there is provided an end member for an aerosol provision device, wherein the end member comprises a receptacle to receive a support for a heater component of the device, wherein the end member is keyed to prevent rotation of the support within the receptacle.

Further features and advantages of the invention will become apparent from the following description of preferred embodiments of the invention, given by way of example only, which is made with reference to the accompanying drawings.

DETAILED DESCRIPTION

Figure 1:
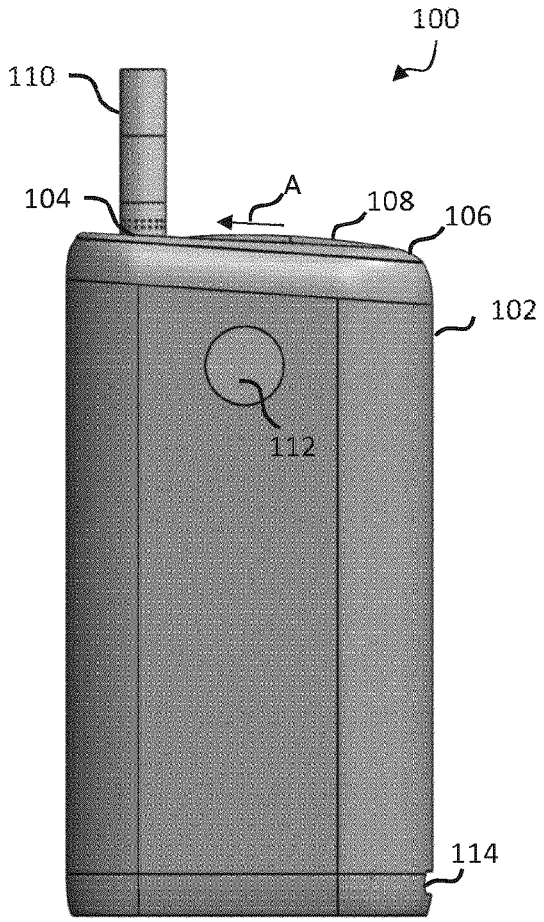
FIG. 1 shows a front view of an example of an aerosol provision device.

As used herein, the term "aerosol generating material" includes materials that provide volatilised components upon heating, typically in the form of an aerosol. Aerosol generating material includes any tobacco-containing material and may, for example, include one or more of tobacco, tobacco derivatives, expanded tobacco, reconstituted tobacco or tobacco substitutes. Aerosol generating material also may include other, non-tobacco, products, which, depending on the product, may or may not contain nicotine. Aerosol generating material may for example be in the form of a solid, a liquid, a gel, a wax or the like. Aerosol generating material may for example also be a combination or a blend of materials. Aerosol generating material may also be known as "smokable material".

Apparatus is known that heats aerosol generating material to volatilise at least one component of the aerosol generating material, typically to form an aerosol which can be inhaled, without burning or combusting the aerosol generating material. Such apparatus is sometimes described as an "aerosol generating device", an "aerosol provision device", a "heat-not-burn device", a "tobacco heating product device" or a "tobacco heating device" or similar. Similarly, there are also so-called e-cigarette devices, which typically vaporise an aerosol generating material in the form of a liquid, which may or may not contain nicotine. The aerosol generating material may be in the form of or be provided as part of a rod, cartridge or cassette or the like which can be inserted into the apparatus. A heater for heating and volatilising the aerosol generating material may be provided as a "permanent" part of the apparatus.

An aerosol provision device can receive an article comprising aerosol generating material for heating. An "article" in this context is a component that includes or contains in use the aerosol generating material, which is heated to volatilise the aerosol generating material, and optionally other components in use. A user may insert the article into the aerosol provision device before it is heated to produce an aerosol, which the user subsequently inhales. The article may be, for example, of a predetermined or specific size that is configured to be placed within a heating chamber of the device which is sized to receive the article.

A first aspect of the present disclosure defines an aerosol provision device with a heater component. The heater component can receive aerosol generating material. For example, the heater component may be substantially tubular (e.g., hollow) and can receive the aerosol generating material therein. In one example, the aerosol generating material is tubular or cylindrical in nature, and may be known as a "tobacco stick", for example, the aerosolizable material may comprise tobacco formed in a specific shape which is then coated, or wrapped in one or more other materials, such as paper or foil.

The heater component can be heated by penetrating the heater component with a varying magnetic field, produced by at least one inductor coil. The heated heater component in turn heats the aerosol generating material located within the heater component. Accordingly, the heater component may be a susceptor, for example.

To ensure that the aerosol generating material is heated most efficiently, the internal surface of the heater component should be arranged in close proximity to, or in contact with, the outer surface of the article. However, it has been found that after heating, aerosol can condense and cause the article to adhere to the inside of the heater component. Users might rotate the article to break the adhesion and allow the article to be removed from the heater component, but this can cause the heater component to rotate within the device. In some devices, temperature sensors are affixed to the heater component, and these can come loose or have connections damaged if the heater component is rotated.

To limit rotation of the heater component, at least part of the heater component can be "keyed", e.g., at least part of the heater component has an engagement feature and/or cross-sectional shape which interlocks with a support structure which holds the heater component in place. The support has a corresponding engagement feature and/or cross-sectional shape. This interlocking stops, or makes it more difficult for the heater component to rotate relative to the support.

In certain aspects of the disclosure, the heater component comprises a first portion having a first outer cross section and a second portion having a second outer cross section. The support comprises a receptacle engaged with the second portion of the heater component to hold the heater component. To prevent rotation, the receptacle has an inner cross section corresponding to the second outer cross section of the heater component. The second outer cross section therefore has a shape which corresponds to an inner cross section of the receptacle. The second outer cross section is therefore keyed with the inner cross section.

The second outer cross section may be different to the first outer cross section.

In a particular example, the first outer cross section is circular in shape and the second outer cross section is non-circular in shape. The first portion of the heater component has a first outer cross section that is circular in shape so that it corresponds to the cylindrical shape of the article which is inserted into the heater component. The non-circular shape corresponds to the inner cross section of the receptacle, thereby making it more difficult to rotate the heater component.

In a particular example, the second portion is arranged at one end of the heater component. The end may be a distal end of the heater component, for example. The first portion of the heater component may extend from the other end (such as a proximal end) of the heater component to the second portion. The first portion may be adjacent to the second portion.

The heater component may be received within the receptacle during assembly of the device, for example. The heater component may define a longitudinal axis and the first and second outer cross sections may be taken in a plane that is perpendicular to the longitudinal axis. Rotation may be prevented in an azimuthal direction or circumferential direction around the longitudinal axis of the heater component. The receptacle may define an axis, such that the support is configured to hold the heater component parallel to the axis.

The inner cross section of the receptacle may be substantially the same size as the second outer cross section of the heater component to provide a tight fit between the receptacle and heater component, further limiting relative movement.

The first outer cross section and the second outer cross section may be coaxial. For example, the geometric centers of the first and second outer cross sections are aligned along an axis, such as the longitudinal axis of the heater component.

The first portion may have a first inner cross section that is circular in shape. In some examples the second portion also has a second inner cross section that is circular in shape, while the second outer cross section is non-circular. This may be desirable to ensure that the article is not obstructed by a non-circular portion within the heater component.

The second outer cross section may be at least partially defined by one or more engagement features formed on an outer surface of the second portion. Similarly, the inner cross section may be at least partially defined by one or more corresponding engagement features formed on an inner surface of the receptacle.

The engagement features can be at least one of ridges, protrusions, indentations, notches, recesses and channels, for example. In a particular example, the engagement features of the heater component are indentations formed on the outer surface of the second portion, and the corresponding engagement features of the support are protrusions. The protrusions are configured to be received within the indentations, thereby restricting rotation of the heater component. In another example, the engagement features of the heater component are indentations/channels formed on the outer surface of the second portion, and the corresponding engagement features of the support are protrusions/ridges. In some examples the heater component and support each have a mixture of indentations and protrusions. Thus, it is the engagement features which give the second outer cross section and inner cross section their shape.

The heater component may comprise a plurality of engagement features formed on the outer surface of the second portion, wherein the engagement features are equally spaced around the outer surface. Similarly, the support may comprise a plurality of corresponding engagement features formed on the inner surface of the receptacle, wherein the corresponding engagement features are equally spaced around the inner surface. Such an arrangement provides a more uniform locking feature that is more difficult to rotate by distributing sheer stresses around the perimeter rather than concentrating at one point. Thus, the second outer cross section defines an outer perimeter, and the plurality of engagement features are equally spaced around the perimeter. Similarly, the inner cross section defines an inner perimeter and the plurality of engagement features are equally spaced around the perimeter.

In one example, the heater component comprises three or four engagement features, such as three or four indentations, and the recess comprises three or four engagement features, such as three or four protrusions. The indentations are dimensioned to receive corresponding protrusions.

The heater component may define a longitudinal axis, and the one or more engagement features may have a dimension of less than about 1 mm measured in a direction perpendicular to the longitudinal axis. Similarly, the receptacle may define an axis, and the one or more corresponding engagement features may have a dimension less than about 1 mm measured in a direction perpendicular to the axis. The perpendicular direction is measured in a radial direction towards the center of the heater component/recess.

This dimension can be a depth or height of the engagement feature. For example, the indentations may have a depth of less than about 1 mm and the protrusions may have a height of less than about 1 mm.

It has been found that these dimensions provide a good balance between acting to limit rotation without deforming the heater component to an extent that its structural integrity is affected.

In a particular example, the dimensions are of less than about 0.75 mm, or less than about 0.5 mm, or less than about 0.35 mm.

In another example, the dimensions are of less than about 0.32 mm. This provides a good balance between structural integrity while limiting rotation of the heater component.

The one or more engagement features of the heater component may have a dimension of less than about 15% of the diameter of the first portion of the heater component. More preferably, the one or more engagement features of the heater component may have a dimension of less than about 10% of the diameter of the first portion, or may have a dimension of less than about 6% of the diameter of the first portion. For example, the first portion may have a diameter of between about 4 mm and about 8 mm, or between about 5 mm and 6 mm, such as about 5.55 mm. The diameter is the outer diameter of the heater component.

The one or more engagement features of the recess may have a dimension of less than about 15% of the diameter of the recess. More preferably, the one or more engagement features of the heater component may have a dimension of less than about 10% of the diameter of the recess, or may have a dimension of less than about 6% of the diameter of the recess. For example, the recess may have a diameter of between about 4 mm and about 8 mm, or between about 5 mm and 6 mm, such as about 5.55 mm.

The second portion (and therefore the engagement features) may extend over less than about 15% of a length of the heater component. Thus, the engagement features may have a certain length, measured in a direction parallel to the longitudinal axis of the heater component. The length of the heater component is measured in a direction along the longitudinal axis. In certain examples, the engagement features weaken the structural rigidity of the heater component. For example, if the engagement features are indentations, the heater component may be more prone to bending or breaking. It has been found that by limiting the extension of the second portion to less than 15% of the length of the heater component provides a good balance been reducing the ability to rotate the heater component while providing a suitably robust heater component.

In a particular example, the second portion extends over less than about 10% of the length of the heater component, or less than about 7% of the length. These lengths provide a balance between providing a keying feature to prevent rotation and robustness of the heater component.

In a particular example, the heater component has a length dimension (measured in a direction parallel to the longitudinal axis of the heater component), of about 40 mm to about 50 mm. In another example, the heater component has a length dimension of about 40 mm to about 45 mm. More particularly, the heater component may have a length dimension of about 44 mm to about 45 mm.

In an example, the second portion extends along the heater component by less than about 5 mm. The engagement features may therefore have a length (measured in a direction along the longitudinal axis of the heater component) by less than about 5 mm. In a preferred example, the second portion extends along the heater component by less than about 3.5 mm.

In one example the receptacle defines an axis and the one or more engagement features have a length of less than about 5 mm measured in a direction parallel to the axis. More preferably, the one or more engagement features have a length of less than about 4 mm, or less than about 3.5 mm.

In the second aspect, there is provided heater component for an aerosol provision device, comprising a first portion having a first outer cross section that is circular in shape and a second portion having a second outer cross section that is non-circular in shape.

The second outer cross section may be the same shape as an inner cross section of a receptacle of the aerosol provision device, thereby to prevent rotation of the heater component within the receptacle.

In the third aspect, there is provided a support for a heater component of an aerosol provision device, wherein the support defines a receptacle to receive the heater component, wherein the receptacle has an inner cross section that is non-circular in shape.

The inner cross section may be the same shape as an outer cross section of the heater component, thereby to prevent rotation of the heater component within the receptacle. The receptacle can receive an end of the heater component.

In the fifth aspect there is provided method of manufacturing a heater component for an aerosol provision device, the method comprising: (i) providing a cylindrical heater component having an outer cross section that is circular in shape, and (ii) deforming the heater component such that an outer cross section of a portion of the heater component is non-circular. The other portion of the heater component has a circular outer cross section.

In one example, the portion of the heater component is an end of the heater component.

In a particular example, indentations can be formed in the heater component. The non-circular cross section could be formed by a jig, for example. Alternatively, the non-circular cross section could be formed by scoring the outer surface of the heater component. In another example, the non-circular cross section could be formed by inserting the heater component into a receptacle with a force which causes the heater component to be deformed. For example, the receptacle could be a receptacle of a heater component support and the receptacle comprises a plurality of protrusions. As the heater component is forced into the receptacle, indentations may be formed by the protrusions.

The heater component may have a unitary construction. A unitary construction can mean that the heater component is easier to manufacture, and is less likely to fracture.

In a first example, the heater component is initially formed (in step (i)), by rolling a sheet of material (such as metal) into a tube and sealing/welding the heater component along the seam. In some examples, the ends of the sheet overlap when they are sealed. In other examples, the ends of the sheet do not overlap when they are sealed.

In a second example, the heater component is initially formed by deep drawing techniques. This technique can provide a heater component that is seamless. The first example mentioned above can, however, produce a heater component in a shorter period of time.

Other methods of forming a seamless heater component include reducing the wall thickness of a relatively thick hollow tube to provide a relatively thin hollow tube. The wall thickness can be reduced by deforming the relatively thick hollow tube. In one example, the wall can be deformed using swaging techniques. In one example, the wall can be deformed via hydroforming, where the inner circumference of the hollow tube is increased. High pressure fluid can exert a pressure on the inner surface of the tube. In another example, the wall can be deformed via ironing. For example, the walls of the heater component tube can be pressed together between two surfaces.

In the sixth aspect, the heater component is keyed to prevent rotation of the heater component within a receptacle of the aerosol provision device. In some examples, the heater component is generally cylindrical. For example, the heater component may be cylindrical along a portion of its length, and may comprise a non-cylindrical portion. The non-cylindrical portion may define an engagement feature which acts as a "key" to prevent rotation of the heater component. In certain examples, keying may mean that a component/portion of an entity is shaped to engage/lock with a component/portion of another entity which has a corresponding shape.

In addition to, or instead of, the above described heater component/support keying and engagement features, the support can comprise further keying features to enable it to lock/engage with an end member of the aerosol provision device. It has been found that it is beneficial to limit or stop relative rotation between the support and end member of the device. For example, even when the heater component and support are keyed, the user may still be able to rotate the heater component with such a force that it causes the heater component and support to rotate together meaning that the support rotates relative to the end member. To avoid this, the support may comprise one or more locking features that engage with one or more corresponding locking features of the end member. These locking features stop or restrict rotation of the support relative to the end member.

An end member is an element that is arranged at, or towards one end of the aerosol provision device. The end member defines a receptacle configured to receive the support. The end member may comprise at least one attachment element which allows the end member to be connected to other components of the device, such as a battery support. The end member may comprise an end surface which defines part of an outer surface of the aerosol provision device. For example, the end surface may form a bottom surface of the device.

In the eighth aspect of the present disclosure there is provided an aerosol provision device, comprising: a heater component, a support configured to engage the heater component to hold the heater component, and an end member, where the end member defines a receptacle and the support is at least partially received within the receptacle. The support comprises a first locking feature engaged with a second locking feature of the end member, thereby to prevent rotation of the support relative to the end member. In one example the receptacle comprises the second locking feature.

In some examples, the support comprises a plurality of first locking features engaged with a plurality of second locking features of the receptacle. A locking feature may also be known as a keying feature or an engagement feature.

The end member may comprise a base and an inner wall extending from the base. The inner wall may extend fully or partially around the base. The inner wall and base may therefore define the receptacle within which the support is received. The inner wall may define an axis, which is substantially perpendicular to the base.

In a particular example, the first locking feature may comprise a recess formed in an outer surface of the support, and the second locking feature may comprise a protrusion. The protrusion can therefore be received within the recess. The protrusion may extend into the receptacle, for example. This arrangement provides an effective and robust locking mechanism to reduce/stop rotation of the support. This particular locking mechanism also ensures that the device can be assembled easily. For example, the support can be introduced into the receptacle so that the protrusion is received within the recess. The recess may be known as a notch, channel, indentation, hole, or aperture.

The heater component may define a longitudinal axis, and the protrusion may extend into the receptacle from an inner wall of the end member in a direction perpendicular to the longitudinal axis (when the heater component is engaged with the support, and the support is engaged with the end member). The "direction perpendicular to the longitudinal axis" is a direction which is parallel to the base of the end member. The longitudinal axis may be a longitudinal axis of the support.

The protrusion may or may not be adjoined to the base of the end member in addition to the inner wall. The protrusion may therefore be a "spike" or "ridge" which extends from only the inner wall of the receptacle.

The recess may extend into the support in a direction perpendicular to the longitudinal axis of the heater component/support (e.g., radially inwards).

The heater component may define a longitudinal axis, and the protrusion may extend into the receptacle from the base of the end member in a direction parallel to the longitudinal axis. The longitudinal axis may be a longitudinal axis of the support.

The protrusion may or may not be adjoined to the inner side wall of the end member in addition to the base. The protrusion may therefore be a "spike" or "ridge" which extends from only the base of the receptacle.

In a particular example, the protrusion extends into the receptacle from both the inner wall and the base. Thus, the protrusion may be connected to, and be supported by, the base and inner wall. In such a configuration, the protrusion may be more robust, and less likely to break or bend when a user causes the support to rotate.

In an alternative example, the first locking feature may comprise a protrusion formed on an outer surface of the support and the second locking feature may comprise a recess, where the protrusion is received within the recess.

The heater component may define a longitudinal axis, and the protrusion may extend from the support in a direction parallel to the longitudinal axis. For example, the protrusion may extend from a bottom surface of the support. Additionally or alternatively, the protrusion may extend from the outer surface of the support in a direction perpendicular to the longitudinal axis. For example, the protrusion may extend from a side surface of the support (e.g., radially outwards of the support).

In one example, the locking features of the support may be a mixture of recesses and protrusions, and the locking features of the end member may be a mixture of corresponding protrusions and recesses.

The heater component may define a longitudinal axis, and the first locking feature may have a dimension of less than about 5 mm measured in a direction perpendicular to the longitudinal axis and the second locking feature may have a dimension of less than about 5 mm measured in a direction perpendicular to the longitudinal axis. For example, the protrusion/recess may have a height/depth of less than about 5 mm. It has been found that locking features which have these dimensions provide a good balance between limiting rotation, while reducing the material required to form the locking features.

In a particular example, the dimension is between about 2 mm and about 4 mm, for example, about 2 mm. Locking features of these dimensions provide an optimum balance between preventing rotation and reducing the material required to form the locking features. Furthermore, locking features of these dimensions do not require the size of the device to be increased to allow for the locking features. Dimensions of this size are robust enough to prevent rotation.

The heater component may define a longitudinal axis, and the first locking feature may have a width dimension of less than about 3 mm measured in a direction around an outer perimeter of the support and the second locking feature may have a width dimension of less than about 3 mm measured in a direction around an inner perimeter of the receptacle. For example, a recess may have a width/gap of less than about 3 mm and a protrusion may have a width of less than about 3 mm. It has been found that locking features which have these dimensions provide a good balance between limiting rotation, while reducing the material required to form the locking features.

In a particular example, the width dimension is between about 1 mm and about 2 mm. Dimensions of this size are robust enough to prevent rotation, while reducing the material and space required to provide a locking feature.

In the ninth aspect, a support for a heater component of an aerosol provision device is provided. The support is configured to engage the heater component to hold the heater component, and be received with a receptacle of an end member of the device. The support comprises a first locking feature configured to engage a second locking feature of the end member.

The support may comprise any or all of the features described above.

The first locking feature may comprise one of (i) a recess formed in an outer surface of the support and (ii) a protrusion formed on an outer surface of the support.

The support may define an axis, such as a longitudinal axis, and the first locking feature may have a dimension of less than about 5 mm measured in a direction perpendicular to the axis.

In the tenth aspect an end member for an aerosol provision device is provided. The end member defines a receptacle configured to receive a support for a heater component of the device and the end member comprises a locking feature configured to engage a corresponding locking feature of the support.

The locking feature of the end member may be referred to as a second locking feature and the corresponding locking feature may be referred to as a first locking feature. In some examples the recess may comprise the locking feature.

The end member may comprise any or all of the features described above.

The locking feature may comprise one of a recess formed in the receptacle and a protrusion formed in the receptacle. The protrusion may be adjoined to one or more surfaces in the receptacle, such as a base or inner wall for example.

The end member may comprise a base and an inner wall extending from the base, and the locking feature may comprise a protrusion extending into the receptacle from at least one of the inner wall and the base.

The inner wall may define an axis, and the protrusion may extend into the receptacle from the inner wall in a direction perpendicular to the axis. Additionally or alternatively, the protrusion may extend into the receptacle from the base of the receptacle in a direction perpendicular to the base (e.g., parallel to the axis defined by the inner wall). The protrusion may extend into the receptacle from the inner wall by less than about 5 mm. The protrusion may therefore have a height dimension measured in a direction perpendicular to the axis defined by the inner wall. The inner wall may also be known as a side wall.

In the eleventh aspect a support for a heater component of an aerosol provision device is provided. A portion of the support may be keyed to prevent rotation of the support within an end member of the device. The keying may be provided by one or more locking features for example. Another portion of the support may also be keyed to prevent rotation of the support with respect to the heater component.

In the twelfth aspect, an end member for an aerosol provision device is provided. The end member may comprise a receptacle to receive a support for a heater component of the device. The end member may be keyed to prevent rotation of the support within the receptacle. For example, the recess of the end member may be keyed.

In some examples, coil(s) is/are configured to, in use, cause heating of at least one electrically-conductive heating component/element (also known as a heater component/element), so that heat energy is conductible from the at least one electrically-conductive heating component to aerosol generating material to thereby cause heating of the aerosol generating material.

In some examples, the coil(s) is/are configured to generate, in use, a varying magnetic field for penetrating at least one heating component/element, to thereby cause induction heating and/or magnetic hysteresis heating of the at least one heating component. In such an arrangement, the or each heating component may be termed a "susceptor". A coil that is configured to generate, in use, a varying magnetic field for penetrating at least one electrically-conductive heating component, to thereby cause induction heating of the at least one electrically-conductive heating component, may be termed an "induction coil" or "inductor coil".

The device may include the heating component(s), for example electrically-conductive heating component(s), and the heating component(s) may be suitably located or locatable relative to the coil(s) to enable such heating of the heating component(s). The heating component(s) may be in a fixed position relative to the coil(s). Alternatively, both the device and such an article may comprise at least one respective heating component, for example at least one electrically-conductive heating component, and the coil(s) may be to cause heating of the heating component(s) of each of the device and the article when the article is in the heating zone.

In some examples, the coil(s) is/are helical. In some examples, the coil(s) encircles at least a part of a heating zone of the device that is configured to receive aerosol generating material. In some examples, the coil(s) is/are helical coil(s) that encircles at least a part of the heating zone. The heating zone may be a receptacle, shaped to receive the aerosol generating material.

In some examples, the device comprises an electrically-conductive heating component that at least partially surrounds the heating zone, and the coil(s) is/are helical coil(s) that encircles at least a part of the electrically-conductive heating component. In some examples, the electrically-conductive heating component is tubular. In some examples, the coil is an inductor coil.

Preferably, the device is a tobacco heating device, also known as a heat-not-burn device.

FIG. 1 shows an example of an aerosol provision device 100 for generating aerosol from an aerosol generating medium/material. In broad outline, the device 100 may be used to heat a replaceable article 110 comprising the aerosol generating medium, to generate an aerosol or other inhalable medium which is inhaled by a user of the device 100.

The device 100 comprises a housing 102 (in the form of an outer cover) which surrounds and houses various components of the device 100. The device 100 has an opening 104 in one end, through which the article 110 may be inserted for heating by a heating assembly. In use, the article 110 may be fully or partially inserted into the heating assembly where it may be heated by one or more components of the heater assembly.

The device 100 of this example comprises a first end member 106 which comprises a lid 108 which is moveable relative to the first end member 106 to close the opening 104 when no article 110 is in place. In FIG. 1, the lid 108 is shown in an open configuration, however the cap 108 may move into a closed configuration. For example, a user may cause the lid 108 to slide in the direction of arrow "A".

The device 100 may also include a user-operable control element 112, such as a button or switch, which operates the device 100 when pressed. For example, a user may turn on the device 100 by operating the switch 112.

The device 100 may also comprise an electrical component, such as a socket/port 114, which can receive a cable to charge a battery of the device 100. For example, the socket 114 may be a charging port, such as a USB charging port. In some examples the socket 114 may be used additionally or alternatively to transfer data between the device 100 and another device, such as a computing device.

Figure 2:
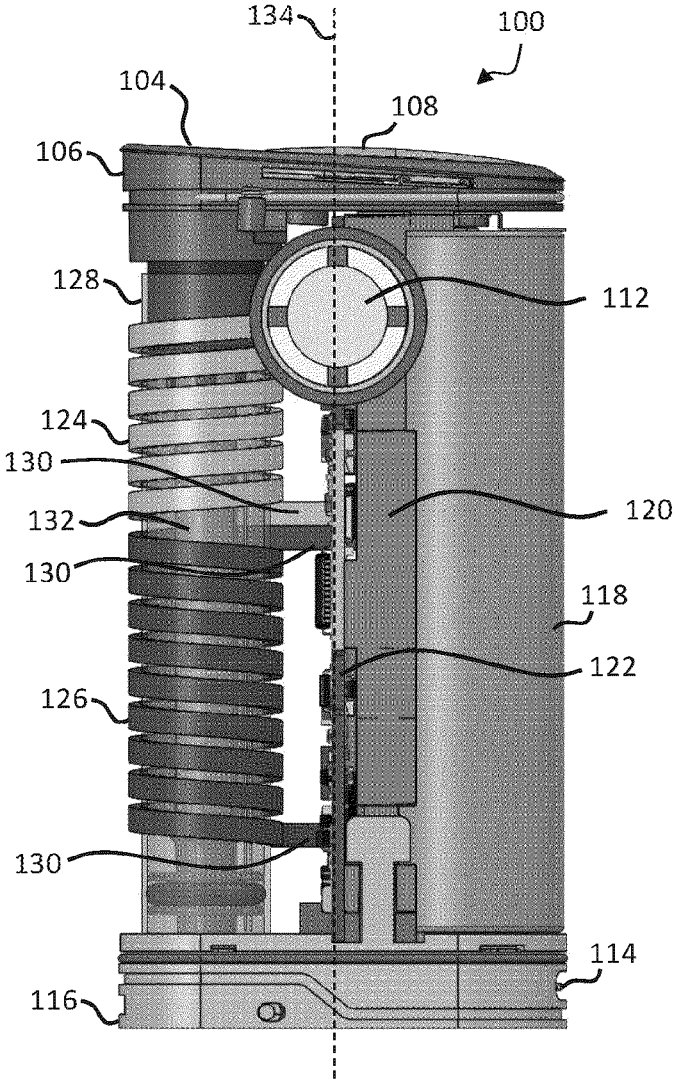
FIG. 2 shows a front view of the aerosol provision device of FIG. 1 with an outer cover removed.

FIG. 2 depicts the device 100 of FIG. 1 with the outer cover 102 removed and without an article 110 present. The device 100 defines a longitudinal axis 134.

As shown in FIG. 2, the first end member 106 is arranged at one end of the device 100 and a second end member 116 is arranged at an opposite end of the device 100. The first and second end members 106, 116 together at least partially define end surfaces of the device 100. For example, the bottom surface of the second end member 116 at least partially defines a bottom surface of the device 100. Edges of the outer cover 102 may also define a portion of the end surfaces. In this example, the lid 108 also defines a portion of a top surface of the device 100.

The end of the device closest to the opening 104 may be known as the proximal end (or mouth end) of the device 100 because, in use, it is closest to the mouth of the user. In use, a user inserts an article 110 into the opening 104, operates the user control 112 to begin heating the aerosol generating material and draws on the aerosol generated in the device. This causes the aerosol to flow through the device 100 along a flow path towards the proximal end of the device 100.

The other end of the device furthest away from the opening 104 may be known as the distal end of the device 100 because, in use, it is the end furthest away from the mouth of the user. As a user draws on the aerosol generated in the device, the aerosol flows away from the distal end of the device 100.

The device 100 further comprises a power source 118. The power source 118 may be, for example, a battery, such as a rechargeable battery or a non-rechargeable battery. Examples of suitable batteries include, for example, a lithium battery, (such as a lithium-ion battery), a nickel battery (such as a nickel-cadmium battery), and an alkaline battery. The battery is electrically coupled to the heating assembly to supply electrical power when required and under control of a controller (not shown) to heat the aerosol generating material. In this example, the battery is connected to a central support 120 which holds the battery 118 in place.

The device further comprises at least one electronics module 122. The electronics module 122 may comprise, for example, a printed circuit board (PCB). The PCB 122 may support at least one controller, such as a processor, and memory. The PCB 122 may also comprise one or more electrical tracks to electrically connect together various electronic components of the device 100. For example, the battery terminals may be electrically connected to the PCB 122 so that power can be distributed throughout the device 100. The socket 114 may also be electrically coupled to the battery via the electrical tracks.

In the example device 100, the heating assembly is an inductive heating assembly and comprises various components to heat the aerosol generating material of the article 110 via an inductive heating process. Induction heating is a process of heating an electrically conducting object (such as a susceptor) by electromagnetic induction. An induction heating assembly may comprise an inductive element, for example, one or more inductor coils, and a device for passing a varying electric current, such as an alternating electric current, through the inductive element. The varying electric current in the inductive element produces a varying magnetic field. The varying magnetic field penetrates a susceptor suitably positioned with respect to the inductive element, and generates eddy currents inside the susceptor. The susceptor has electrical resistance to the eddy currents, and hence the flow of the eddy currents against this resistance causes the susceptor to be heated by Joule heating. In cases where the susceptor comprises ferromagnetic material such as iron, nickel or cobalt, heat may also be generated by magnetic hysteresis losses in the susceptor, e.g., by the varying orientation of magnetic dipoles in the magnetic material as a result of their alignment with the varying magnetic field. In inductive heating, as compared to heating by conduction for example, heat is generated inside the susceptor, allowing for rapid heating. Further, there need not be any physical contact between the inductive heater and the susceptor, allowing for enhanced freedom in construction and application.

The induction heating assembly of the example device 100 comprises a susceptor arrangement 132 (herein referred to as "a susceptor"), a first inductor coil 124 and a second inductor coil 126. The first and second inductor coils 124, 126 are made from an electrically conducting material. In this example, the first and second inductor coils 124, 126 are made from Litz wire/cable which is wound in a helical fashion to provide helical inductor coils 124, 126. Litz wire comprises a plurality of individual wires which are individually insulated and are twisted together to form a single wire. Litz wires are designed to reduce the skin effect losses in a conductor. In the example device 100, the first and second inductor coils 124, 126 are made from copper Litz wire which has a rectangular cross section. In other examples the Litz wire can have other shape cross sections, such as circular.

The first inductor coil 124 is configured to generate a first varying magnetic field for heating a first section of the susceptor 132 and the second inductor coil 126 is configured to generate a second varying magnetic field for heating a second section of the susceptor 132. In this example, the first inductor coil 124 is adjacent to the second inductor coil 126 in a direction along the longitudinal axis 134 of the device 100 (that is, the first and second inductor coils 124, 126 to not overlap). The susceptor arrangement 132 may comprise a single susceptor, or two or more separate susceptors. Ends 130 of the first and second inductor coils 124, 126 can be connected to the PCB 122.

It will be appreciated that the first and second inductor coils 124, 126, in some examples, may have at least one characteristic different from each other. For example, the first inductor coil 124 may have at least one characteristic different from the second inductor coil 126. More specifically, in one example, the first inductor coil 124 may have a different value of inductance than the second inductor coil 126. In FIG. 2, the first and second inductor coils 124, 126 are of different lengths such that the first inductor coil 124 is wound over a smaller section of the susceptor 132 than the second inductor coil 126. Thus, the first inductor coil 124 may comprise a different number of turns than the second inductor coil 126 (assuming that the spacing between individual turns is substantially the same). In yet another example, the first inductor coil 124 may be made from a different material to the second inductor coil 126. In some examples, the first and second inductor coils 124, 126 may be substantially identical.

In this example, the first inductor coil 124 and the second inductor coil 126 are wound in opposite directions. This is can be useful when the inductor coils are active at different times. For example, initially, the first inductor coil 124 may be operating to heat a first section of the article 110, and at a later time, the second inductor coil 126 may be operating to heat a second section of the article 110. Winding the coils in opposite directions helps reduce the current induced in the inactive coil when used in conjunction with a particular type of control circuit. In FIG. 2, the first inductor coil 124 is a right-hand helix and the second inductor coil 126 is a left-hand helix. However, in another embodiment, the inductor coils 124, 126 may be wound in the same direction, or the first inductor coil 124 may be a left-hand helix and the second inductor coil 126 may be a right-hand helix.

The susceptor 132 of this example is hollow and therefore defines a receptacle within which aerosol generating material is received. For example, the article 110 can be inserted into the susceptor 132. In this example the susceptor 120 is tubular, with a circular cross section.

The device 100 of FIG. 2 further comprises an insulating member 128 which may be generally tubular and at least partially surround the susceptor 132. The insulating member 128 may be constructed from any insulating material, such as plastic for example. In this particular example, the insulating member is constructed from polyether ether ketone (PEEK). The insulating member 128 may help insulate the various components of the device 100 from the heat generated in the susceptor 132.

The insulating member 128 can also fully or partially support the first and second inductor coils 124, 126. For example, as shown in FIG. 2, the first and second inductor coils 124, 126 are positioned around the insulating member 128 and are in contact with a radially outward surface of the insulating member 128. In some examples the insulating member 128 does not abut the first and second inductor coils 124, 126. For example, a small gap may be present between the outer surface of the insulating member 128 and the inner surface of the first and second inductor coils 124, 126.

In a specific example, the susceptor 132, the insulating member 128, and the first and second inductor coils 124, 126 are coaxial around a central longitudinal axis of the susceptor 132.

Figure 3:
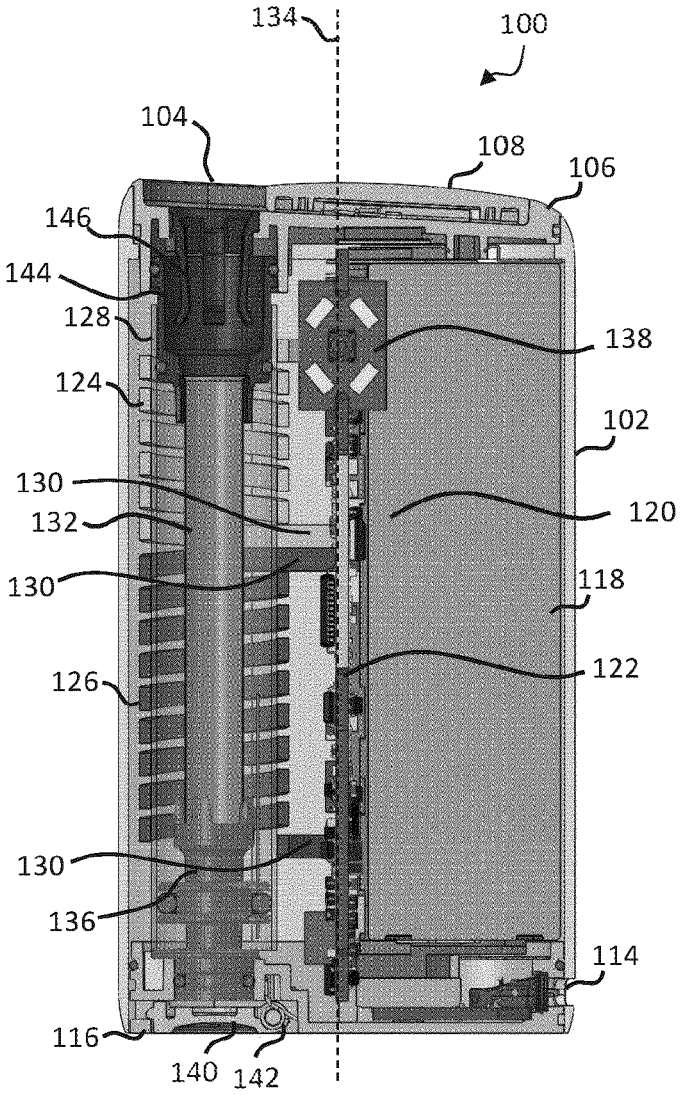
FIG. 3 shows a cross-sectional view of the aerosol provision device of FIG. 1.

FIG. 3 shows a side view of device 100 in partial cross-section. The outer cover 102 is present in this example. The rectangular cross-sectional shape of the first and second inductor coils 124, 126 is more clearly visible.

The device 100 further comprises a support 136 which engages one end of the susceptor 132 to hold the susceptor 132 in place. The support 136 is connected to the second end member 116.

The device may also comprise a second printed circuit board 138 associated within the control element 112.

The device 100 further comprises a second lid/cap 140 and a spring 142, arranged towards the distal end of the device 100. The spring 142 allows the second lid 140 to be opened, to provide access to the susceptor 132. A user may open the second lid 140 to clean the susceptor 132 and/or the support 136.

The device 100 further comprises an expansion chamber 144 which extends away from a proximal end of the susceptor 132 towards the opening 104 of the device. Located at least partially within the expansion chamber 144 is a retention clip 146 to abut and hold the article 110 when received within the device 100. The expansion chamber 144 is connected to the end member 106.

Figure 4:
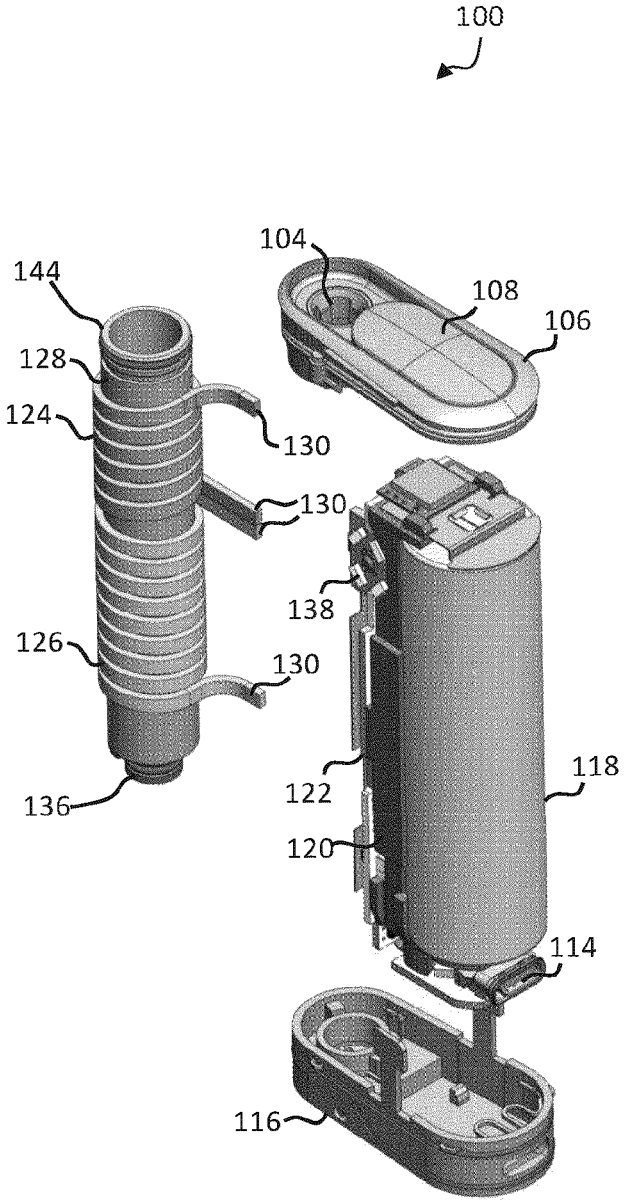
FIG. 4 shows an exploded view of the aerosol provision device of FIG. 2.

FIG. 4 is an exploded view of the device 100 of FIG. 1, with the outer cover 102 omitted.

Figure 5A:
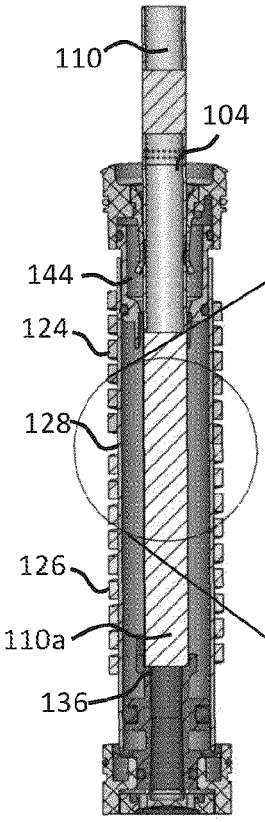
FIG. 5A shows a cross-sectional view of a heating assembly within an aerosol provision device.
Figure 5B:
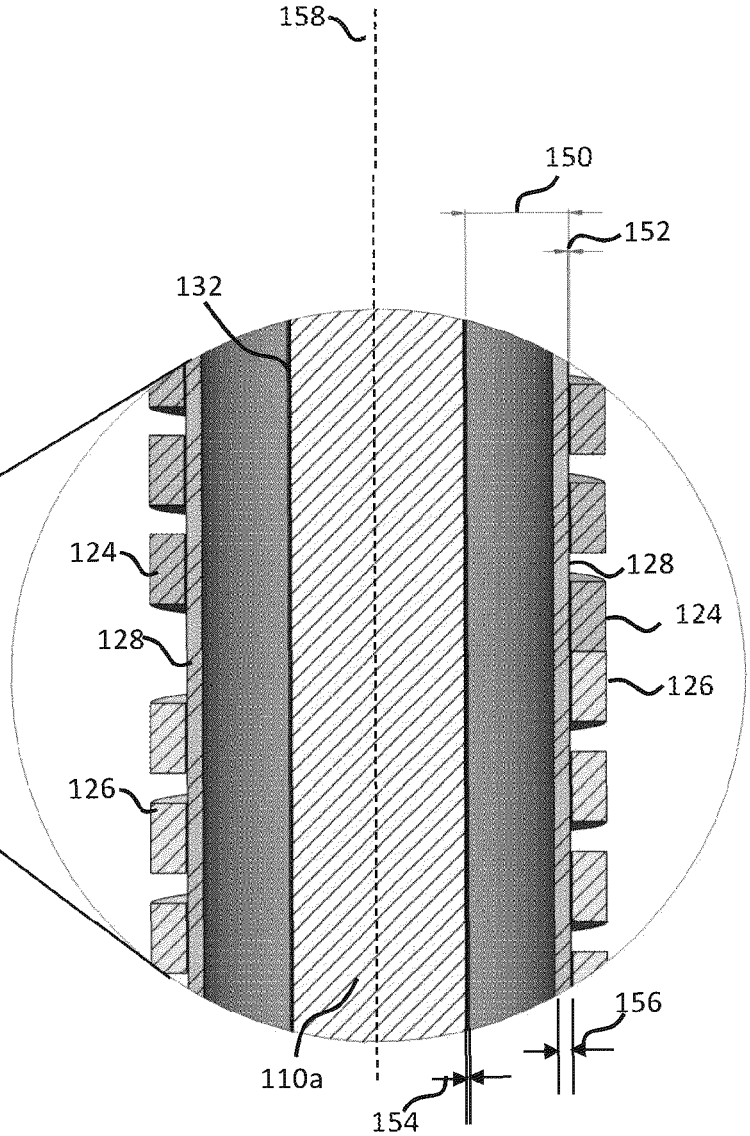
FIG. 5B shows a close-up view of a portion of the heating assembly of FIG. 5A.

FIG. 5A depicts a cross section of a portion of the device 100 of FIG. 1. FIG. 5B depicts a close-up of a region of FIG. 5A. FIGS. 5A and 5B show the article 110 received within the susceptor 132, where the article 110 is dimensioned so that the outer surface of the article 110 abuts the inner surface of the susceptor 132. This ensures that the heating is most efficient. The article 110 of this example comprises aerosol generating material 110*a*. The aerosol generating material 110*a* is positioned within the susceptor 132. The article 110 may also comprise other components such as a filter, wrapping materials and/or a cooling structure.

FIG. 5B shows that the outer surface of the susceptor 132 is spaced apart from the inner surface of the inductor coils 124, 126 by a distance 150, measured in a direction perpendicular to a longitudinal axis 158 of the susceptor 132. In one particular example, the distance 150 is about 3 mm to 4 mm, about 3-3.5 mm, or about 3.25 mm.

FIG. 5B further shows that the outer surface of the insulating member 128 is spaced apart from the inner surface of the inductor coils 124, 126 by a distance 152, measured in a direction perpendicular to a longitudinal axis 158 of the susceptor 132. In one particular example, the distance 152 is about 0.05 mm. In another example, the distance 152 is substantially 0 mm, such that the inductor coils 124, 126 abut and touch the insulating member 128.

In one example, the susceptor 132 has a wall thickness 154 of about 0.025 mm to 1 mm, or about 0.05 mm.

In one example, the susceptor 132 has a length of about 40 mm to 60 mm, about 40-45 mm, or about 44.5 mm.

In one example, the insulating member 128 has a wall thickness 156 of about 0.25 mm to 2 mm, 0.25 to 1 mm, or about 0.5 mm.

Figure 6:
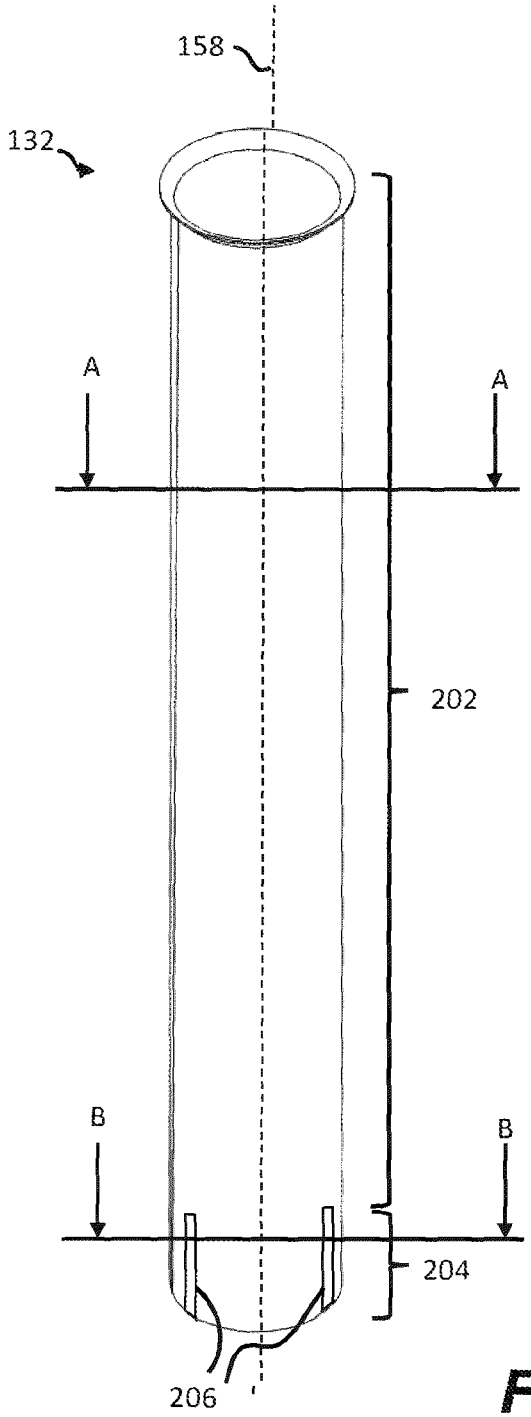
FIG. 6 shows a perspective view of an example susceptor for use within an aerosol provision device.

FIG. 6 depicts the susceptor 132 which, in this example, is constructed from a single piece of material and therefore has unitary construction. The susceptor may be more generally known as a heater component. As mentioned above, the susceptor 132 is hollow and can receive aerosol generating material for heating. In this example, the susceptor 132 has a flared (proximal) end to make it easier for the aerosol generating material to be received within the susceptor. In other examples the susceptor 132 does not have a flared end.

The susceptor 132 comprises a first portion 202 and a second portion 204. The first portion 202 has a first length dimension and the second portion 204 has a second length dimension. These length dimensions are measured in a direction parallel to a longitudinal axis 158 of the susceptor 132. The susceptor 132 has a total length dimension of between about 40 mm and about 50 mm. The second portion 204 has a length of less than about 5 mm. In this particular example, the susceptor 132 has a total length of about 44.5 mm and the second portion 204 has a length of about 3.5 mm such that the second portion extends between about 7% and about 8% over the length of the susceptor 132.

The first portion 202 has a first outer cross section that is circular in shape, and the second portion 204 has a second outer cross section that is non-circular in shape. The outer cross sections are defined by the outer surface of the susceptor. The first outer cross section may be taken in a plane arranged perpendicular to the longitudinal axis 158 at any point along the first portion 202. Even if the first outer cross section is taken in the flared end region, the cross section would be circular in shape. The second outer cross section may be taken in a plane arranged perpendicular to the longitudinal axis 158 at any point along the second portion 204.

In this example the second portion 204 is arranged at one end (the distal end) of the susceptor 132. In other examples, the second portion 204 may not be arranged at the end of the susceptor.

In use, the user inserts an article 110 into the susceptor 132. As shown in FIG. 1, the article 110 has a cylindrical shape, and therefore has a circular cross section. The article 110 is therefore received within the susceptor 132 and the outer cross section of the article 110 conforms to the inner cross section of the first portion 202. In some examples the inner cross section of the second portion 204 is also circular in shape.

The second outer cross section is defined by the outer surface of the susceptor 132 in the second portion 202. To give the second outer cross section its non-circular shape, the second portion 202 comprises one or more engagement features 206. The engagement features 206 may be protrusions and/or indentations, for example. Other engagement features may also be used.

In this example, the engagement features 206 are indentations/channels/notches 206 which extend along the outer surface of the susceptor 132 in a direction parallel to the longitudinal axis 158. The indentations 206 have a length measured along the longitudinal axis 158, where the length is defined by the length of the second portion 204, as mentioned above.

The indentations 206 have a maximum depth dimension measured radially inwards of the susceptor, in a direction perpendicular to the longitudinal axis 158. In this example, the indentations 206 have a maximum depth of less than about 1 mm. In particular, the indentations 206 have a depth of about 0.35 mm. The susceptor 132 has a diameter of between about 4 mm and 8 mm, or between about 5 mm and 6 mm. In this particular example, the non-flared region of the susceptor 132 (and therefore the first portion 202) has a diameter of about 5.55 mm such that the indentations 206 have a depth of about 6% of the diameter of the susceptor 132. The indentations 206 may have a width (measured in an azimuthal direction around the outer perimeter of the susceptor 132) of about 0.1 mm.

The susceptor 132 of this example comprises 4 indentations which are equally spaced around the perimeter of the susceptor 132. The channels formed by the indentations 206 give the second portion 204 its non-circular cross section.

Figure 7:
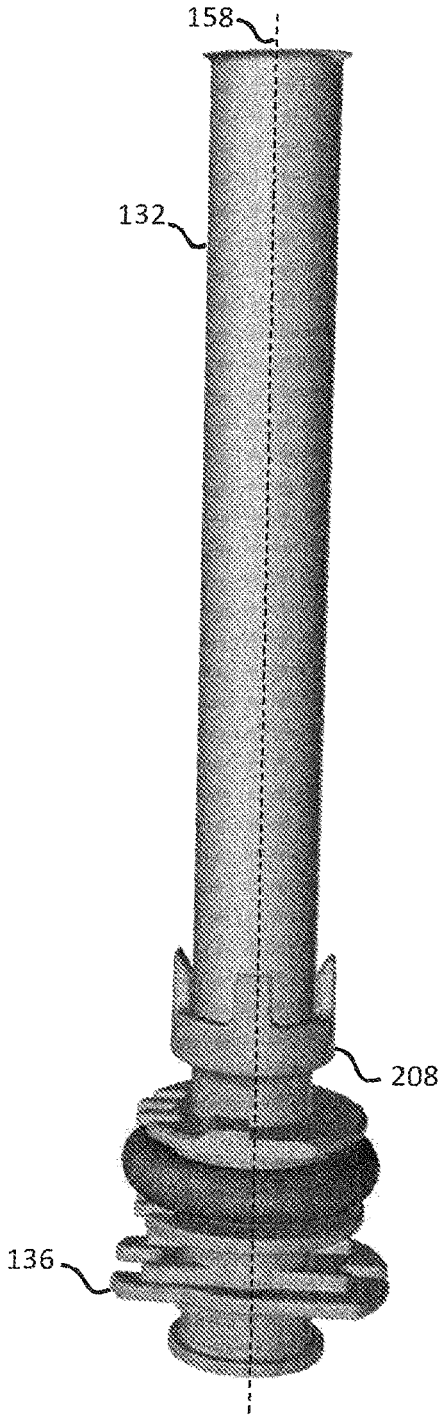
FIG. 7 shows a perspective view of a susceptor engaged with a support.

FIG. 7 depicts a perspective view of the susceptor 132 engaged with a susceptor support 136. The support 136 comprises an engagement portion 208 which engages at least the second portion 204 of the susceptor 132 to hold it in place at a predetermined distance from the one or more inductor coils 124, 126. In this example the support engages a distal end of the susceptor 132, however the support may instead engage the proximal end of the susceptor 132 or may engage the susceptor 132 at any other point along its length.

Figure 8A:
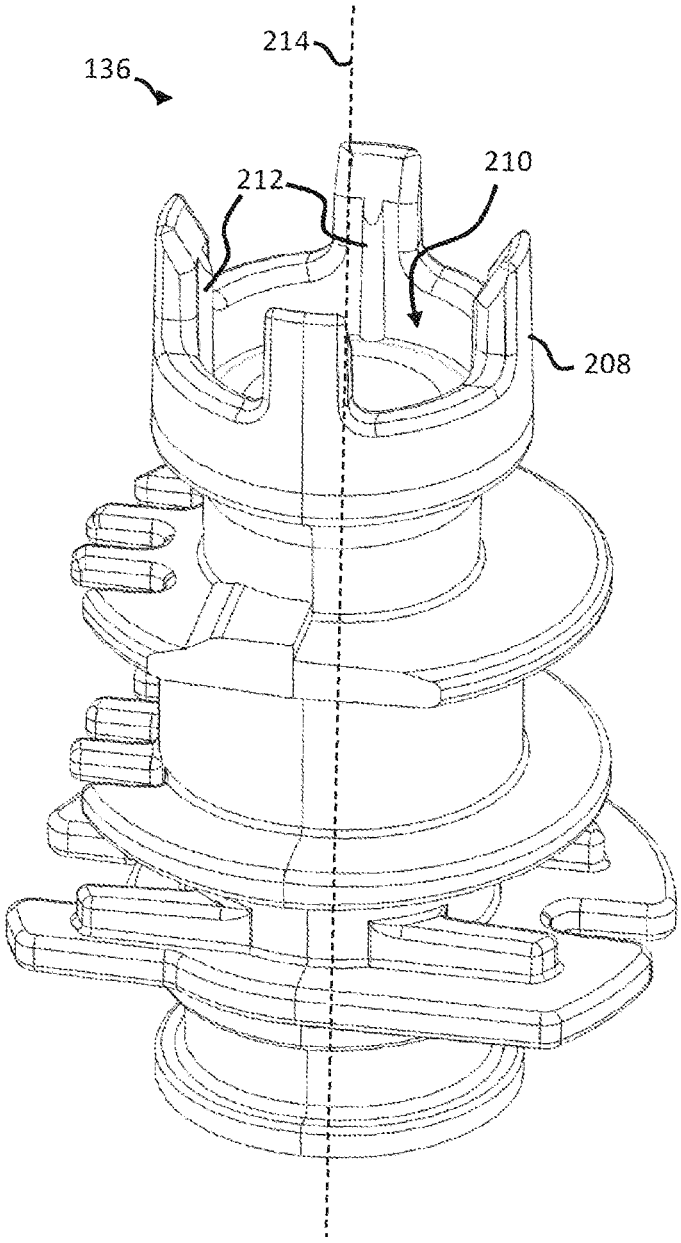
FIG. 8A shows a perspective view of an example support.
Figure 8B:
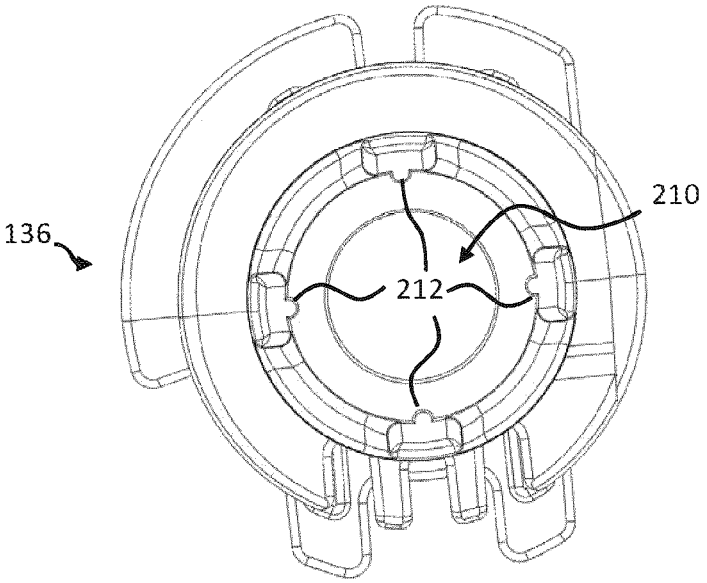
FIG. 8B shows a top-down view of the support of FIG. 8A.

FIG. 8A depicts a perspective view of the support 136. FIG. 8B depicts a top down view of the support 136. The support 136 may be made from an insulating material, such as plastic. In this example, the support 136 is made from polyether ether ketone (PEEK). The support 136 can be made by injection molding, for example.

The support 136 defines an axis 214, such as a longitudinal axis 214. The support 136 engages the susceptor 132 and holds the susceptor 132 parallel to the axis 214. In the engaged position, the longitudinal axis 158 of the susceptor 132 and the longitudinal axis 214 of the support 136 are parallel and may be coaxial.

The support 136 defines a receptacle 210 to receive and hold the susceptor 132. The support may be provided by the engagement portion 208, for example. The engagement portion 208 in this example comprises a plurality of longitudinal extensions which abut the outer surface of the susceptor 132 when received within the receptacle 210.

The receptacle 210 has an inner cross section corresponding to the second outer cross section of the susceptor 132, thereby to prevent rotation of the susceptor 132 relative to the support 136. The inner cross section is therefore non-circular in shape.

The inner cross section is defined by the inner surface of the receptacle 210. The inner cross section may be taken in a direction perpendicular to the axis 214. To give the inner cross section its non-circular shape, the receptacle 210 comprises one or more engagement features 212. The engagement features 212 may be protrusions and/or indentations, for example. Other engagement features may also be used. The engagement features 206 of the susceptor 132 therefore engage/interlock with the engagement features 212 of the receptacle 210. This engagement prevents rotation of the susceptor 132 within the receptacle. The susceptor 132 and support 136 are therefore keyed to prevent relative rotation.

In this example, the engagement features 212 of the support 136 are protrusions/ridges 212 which extend along the inner surface of the receptacle 210 in a direction parallel to the axis 214. The protrusions 212 have a length measured along the axis 214. The protrusions 212 are dimensioned to correspond to the dimensions of the indentations 206 of the susceptor 132.

The protrusions 212 have a maximum height dimension measured in a direction perpendicular to the axis 214 (e.g., radially inwards, towards the center of the recess 210). In this example, the protrusions 212 have a maximum height of less than about 1 mm. In this example, the protrusions 212 have a height of about 0.35 mm. The protrusions 212 may have a width (measured in an azimuthal direction around the inner perimeter of the recess 210) of about 0.1 mm.

The support 136 of this example comprises 4 protrusions 212 which are equally spaced around the inner perimeter of the receptacle 210. The protrusions 212 give the receptacle 210 its non-circular cross section. The protrusions may be integrally formed with the support 136, or may be separate and be affixed to the inner surface of the receptacle 210.

Figure 9A:
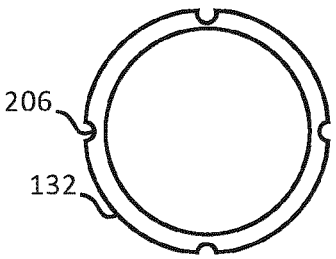
FIG. 9A shows a diagrammatic representation of a cross section of a portion of an example susceptor.
Figure 9B:
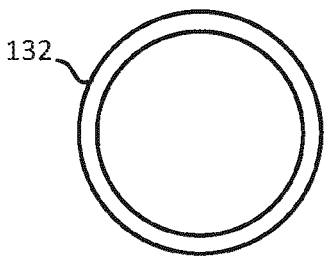
FIG. 9B shows a diagrammatic representation of a cross section of another portion of the example susceptor of FIG. 9A.
Figure 9C:
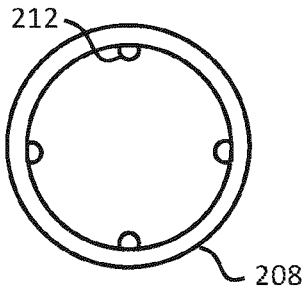
FIG. 9C shows a diagrammatic representation of a cross section of a receptacle of an example support.

FIG. 9A depicts a diagrammatic representation of a cross section of the second portion 204 of the susceptor 132 taken through the line B-B as depicted in FIG. 6. The engagement features 206 are indentations, and give the susceptor 132 an outer cross section that is non-circular. FIG. 9B depicts a diagrammatic representation of the first portion 202 of the susceptor 132 taken through the line A-A as depicted in FIG. 6. The first portion 202 has an outer cross section that is circular. FIG. 9C depicts a diagrammatic representation of a cross section of the engagement portion 208 of the support 136. The engagement features 212 are protrusions, and give the receptacle 210 an inner cross section that is non-circular.

Figure 10A:
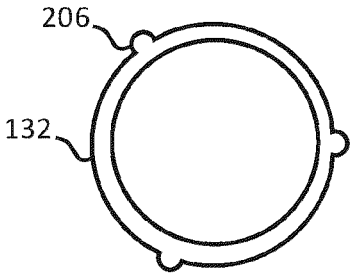
FIG. 10A shows a diagrammatic representation of a cross section of a portion of another example susceptor.
Figure 10B:
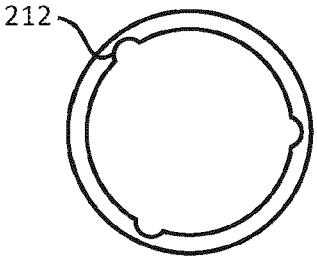
FIG. 10B shows a diagrammatic representation of a cross section of a receptacle of another example support.

FIG. 10A depicts a diagrammatic representation of a cross section thorough a second portion of another example susceptor. In this example, the engagement features 206 are protrusions, and give the susceptor 132 an outer cross section that is non-circular. The protrusions may be integrally formed with the susceptor, or may be separate and be affixed to the outer surface of the susceptor. FIG. 10B depicts a diagrammatic representation of a cross section of an engagement portion of another example support. The engagement features 212 are indentations, and give the receptacle an inner cross section that is non-circular. In FIGS. 10A and 10B the susceptor and receptacle each have three engagement features.

Figure 11:
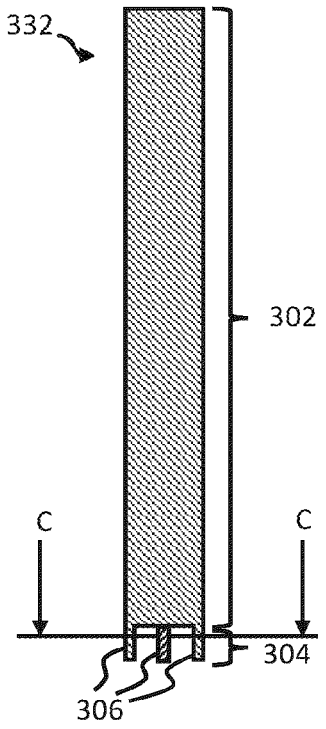
FIG. 11 shows a diagrammatic representation of another example susceptor.

FIG. 11 is a diagrammatic representation of another example susceptor 332 which can be used in the device 100. Like the susceptor in FIGS. 6-10, the susceptor 332 is keyed to prevent rotation of the susceptor 332. The susceptor 332 comprises a first portion 302 and a second portion 304. The first portion 302 has a first outer cross section that is circular in shape, and the second portion 304 has a second outer cross section that is non-circular in shape. In the example of FIG. 11, the end portion of the susceptor 332 is keyed.

To give the second outer cross section its non-circular shape, the second portion 302 comprises one or more engagement features 306. In this example, the engagement features 306 are protrusions 306 which extend from an end of the susceptor 132 in a direction parallel to a longitudinal axis of the susceptor 332. The protrusions may be integrally formed with the susceptor 332, or may be separate and be affixed to the end of the susceptor 332. In this example there are four engagement features 306.

Figure 12:
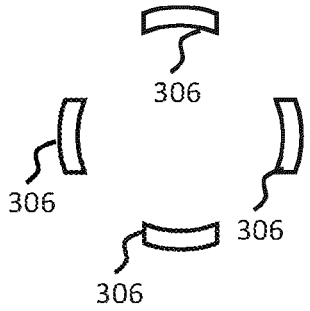
FIG. 12 shows a diagrammatic representation of a cross section of a portion of the susceptor of FIG. 11.

FIG. 12 depicts a diagrammatic representation of a cross section thorough the second portion 304 the susceptor 332 taken through the line C-C depicted in FIG. 11. In this example, the engagement features 206 are longitudinal protrusions, and give the susceptor 132 an outer cross section that is non-circular.

Figure 13:
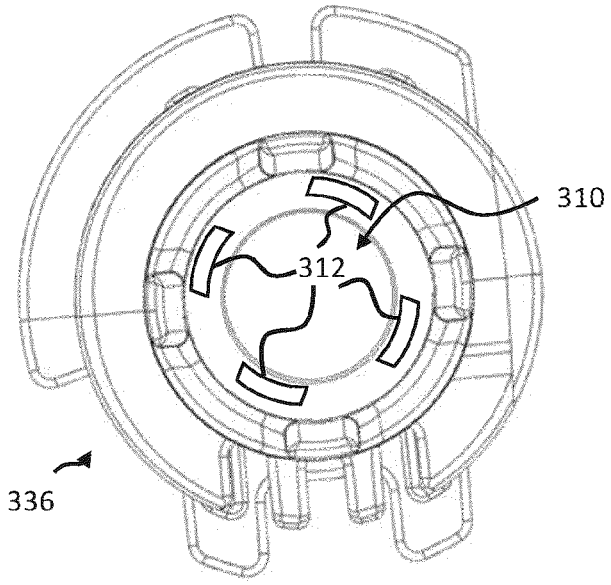
FIG. 13 shows a top-down view of another example support.

FIG. 13 depicts a top down view of another example support 336 which is keyed to prevent rotation of the susceptor 332. The support 226 comprises one or more engagement features 312 configured to engage with the engagement features 306 of the susceptor 332. In this example, the engagement features 312 are indentations, recesses, or slots configured to receive the protrusions 306 of the susceptor 332.

In any of the examples described above, the first portion of the susceptor may have an inner and/or outer cross section which varies in size along its length (in terms of area and diameter).

The features described above in relation to FIGS. 6-13 help prevent the susceptor from rotating within the aerosol provision device. As mentioned, the susceptor is keyed with the support to stop the susceptor from rotating. In addition to, or instead of the susceptor/support keying, the support can also be keyed with an end member. This stops the susceptor and support from rotating within the device, relative to the end member. For example, a user may rotate an article which causes the susceptor to rotate with such a force that causes the susceptor and support to rotate together. Thus, the susceptor and support may rotate relative to the end member. To avoid this, the support may comprise one or more locking features that engage with one or more corresponding locking features of the end member. These locking features stop or restrict rotation of the support relative to the end member. Thus, the support can be keyed with the end member.

In some examples, the engagement features of the susceptor may be formed when the susceptor is inserted into the support. For example, protrusions or ridges formed in the support may cause the susceptor to deform around the protrusions or ridges, thereby creating a corresponding engagement feature in the susceptor. This may make manufacturing easier, for example because there is no need to align the susceptor with the support during assembly. This may be most useful when the susceptor is has relatively low radial strength. Other types of engagement feature may also be formed in the susceptor in this way, for example an asymmetrical cross section.

Figure 14B:
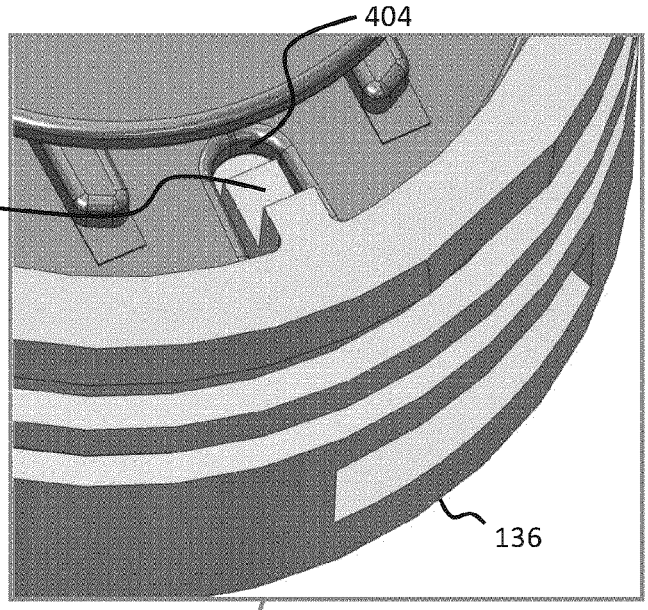
FIG. 14B shows an enlarged perspective view of a portion of FIG. 14A.
Figure 14A:
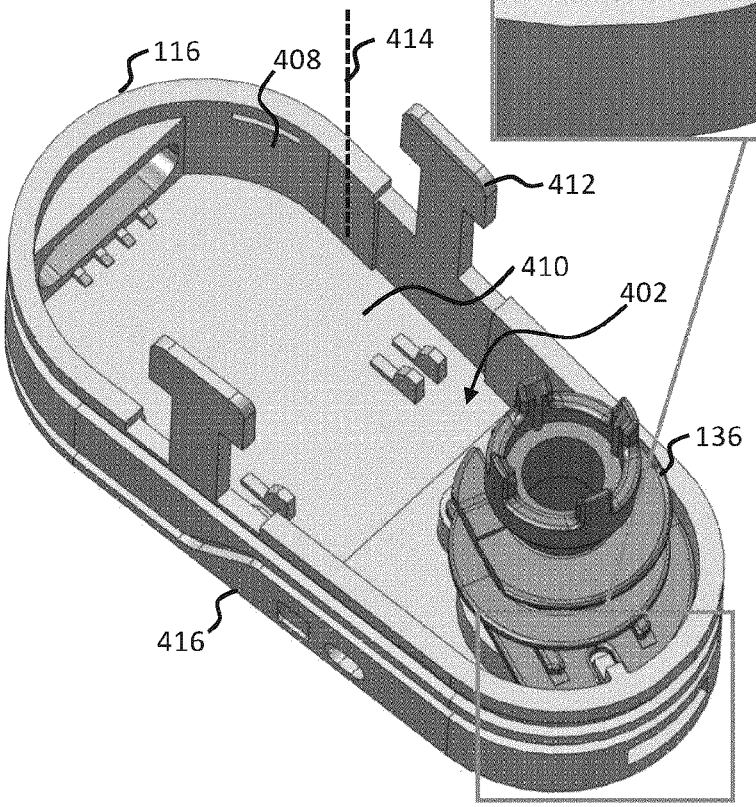
FIG. 14A shows a perspective view of an end member engaged with the support of FIG. 8A.

FIG. 14A depicts the end member 116 described in relation to FIG. 2 engaged with the support 136. FIG. 14B depicts a close-up of locking features which act to prevent rotation of the support 136 relative to the end member 116.

The end member 116 can be arranged at one end of the device 100. As shown, the end member 116 defines a receptacle 402. The receptacle 402 is defined by one or more inner walls 408, also known as side walls, and a base 410. The inner walls 408 extend away from the base 410 and define an axis 414. The axis 414 may be parallel to the longitudinal axis 134 of the device 100, and/or the longitudinal axis 158 of the susceptor 132 and/or the longitudinal axis 214 of the support 136. The inner walls 408 are therefore perpendicular to the base 410. In other examples the axis 414 may be angled with respect to any of these axes. The base 410 defines a flat surface in this example, but it may be curved in other examples.

The end member 116 comprises an end surface 416 which defines part of an outer surface of the aerosol provision device 100. For example, the end surface 416 may form a bottom surface of the device 100.

Optionally, the end member 116 may also comprise at least one attachment element 412 which allows the end member 116 to be connected to the battery support 120.

As shown in FIG. 14A, an end of the support 136 is received within the receptacle 402. The receptacle 402 may comprise one or more features which abut the support 136. To stop the support 136 from being able to rotate within the receptacle 402, the support 136 comprises a first locking feature 404 and the end member 116 comprises a second locking feature 406. FIG. 14B more clearly shows the engagement of the first and second locking features 404, 406. In this example, the second locking feature 406 is a component of the receptacle 402, however in other examples the second locking feature 406 may be located anywhere on the end member 116 provided that it engages with the first locking feature 404 of the support 136.

In the example of FIGS. 14A and 14B, the first locking feature 404 is a recess 404 formed in an outer surface of the support 136, and the second locking feature 406 is a protrusion 406 which extends into the receptacle 402. The protrusion 406 is dimensioned to be received within the recess 404. When engaged, the first and second locking features 404, 406 stop the support 136 from being able to rotate in an azimuthal direction around the axis 214 of the support 136.

In an alternative example, the first locking feature 404 may be a protrusion formed on an outer surface of the support 136 and the second locking feature 406 may be a recess.

Figure 15:
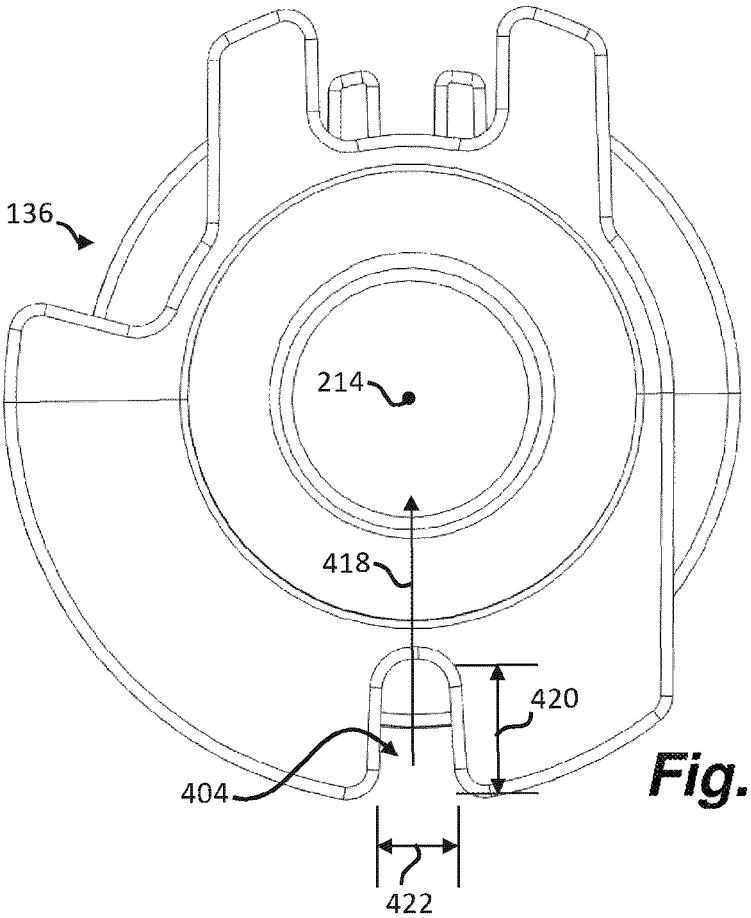
FIG. 15 shows a bottom view of the support of FIG. 8A.

FIG. 15 depicts an underside of the support 136. The first locking feature 404, in the form of a recess, is more clearly shown. The longitudinal axis 214 of the support 136 is shown pointing into the page. The longitudinal axis 214 is arranged parallel to the longitudinal axis 158 of the susceptor 132.

In this example, the recess 404 extends from an outer surface of the support 136 into the support 136 in a direction 418. The direction 418 may be a radial direction, for example. The direction 418 is perpendicular to the longitudinal axes 214, 414. The recess 404 therefore has a depth dimension 420, which may be between about 2 mm and about 5 mm. In this particular example, the depth dimension 420 is about 2 mm.

The recess 404 also has a width dimension 422 measured in a direction around the outer perimeter of the support 136. The outer perimeter is the edge which is located furthest away from the axis 214. The direction around the outer perimeter may therefore be an azimuthal direction around the axis 214. In some examples, the width dimension 422 may be between about 1 mm and about 3 mm. In the example of FIG. 15, the width dimension 422 is between about 1.3 mm and about 1.5 mm.

Figure 16:
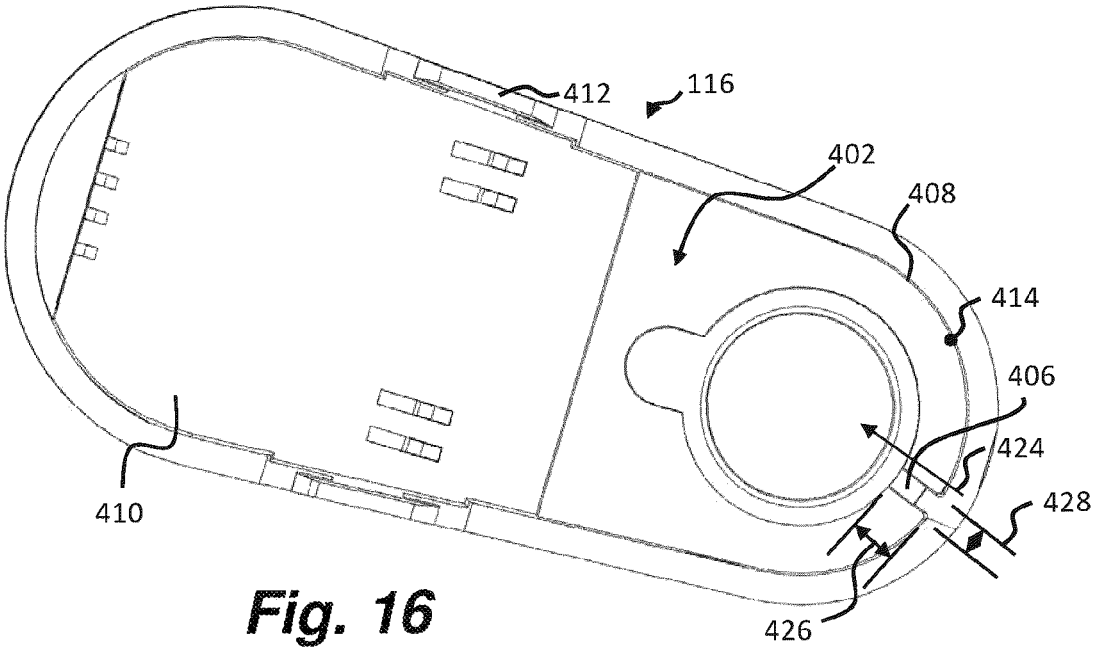
FIG. 16 shows a top-down view of the end member of FIG. 14A.

FIG. 16 depicts a top down view of the end member 116. The second locking feature 406 is in the form of a protrusion. The axis 414 defined by the inner wall 414 is shown pointing into the page. The axis 414 is arranged parallel to the longitudinal axis 158 of the susceptor 132 and parallel to the longitudinal axis of the support 214.

In this example, the protrusion 406 extends into the receptacle 402 from the inner wall 408 of the end member 116 in a direction 424 which is perpendicular to the longitudinal axes 158, 214 and the axis 414. The direction 424 may be a radial direction for example. The protrusion 406 therefore has a height dimension 426, which may be between about 2 mm and about 5 mm. In this particular example, the height dimension 426 is about 2 mm.

In addition to extending from the inner wall 408, the protrusion 406 also extends into the receptacle 402 from the base 410 in a direction parallel to the longitudinal axes 158, 214 and the axis 414. The protrusion 406 is therefore supported by the inner wall 408 and the base 410 for improved stability. In other examples (not depicted), the protrusion may be supported by the base or the inner wall. For example, the protrusion may extend upwards from the base, in a direction parallel to the axis 414, or may extend outwards from the inner wall, in a direction perpendicular to the axis 414.

The protrusion also has a width dimension 428 measured in a direction around an inner perimeter/surface of the receptacle/inner wall 410, 408. The direction around the inner perimeter may be an azimuthal direction around the axes 214, 158. In some examples, the width dimension 428 may be between about 1 mm and about 3 mm. In the example of FIG. 16, the width dimension 428 is between about 1.3 mm and about 1.5 mm.

In FIG. 15, the recess is open around its perimeter. In another example (not depicted), the recess may be in the form of an aperture, which is closed around its perimeter.

In an example where the recess is in the form of an aperture, the protrusion may extend from the base of the end member (in a direction parallel to the longitudinal axis of the support) and be received within the aperture. For example, one or more "prongs" may extend from the base and be received in one or more apertures in the underside of the support.

Alternatively, the support may comprise a protrusion which extends from the underside of the support (in a direction parallel to the longitudinal axis of the support), and be received in a corresponding aperture/recess formed in the base of the end member. For example, one or more "prongs" may extend from the support and be received in one or more apertures in the base of the end member. In a further example, the protrusions may extend from a side surface of the support (rather than the underside of the support).

In an alternative example, the first and second locking features may be substantially the same as the engagement features found on the susceptor and the support. For example, the first locking feature of the support may be a protrusion formed on the outer surface of the support, and the second locking feature may be an indent which is formed on the inner wall of the end member, and the indent receives the protrusion.

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An aerosol provision device, comprising: a heater component, comprising:

a first portion having a first outer cross section; and a second portion having a second outer cross section, wherein the heater component is hollow, such that the heater component defines a receptacle for an article comprising aerosol generating material to be inserted into, such that, in use, a user may insert the article into the receptacle of the heater component and remove the article from the receptacle of the heater component; and a support, comprising:

a receptacle of the support engaged with the second portion of the heater component to hold the heater component, wherein the receptacle of the support has an inner cross section corresponding to the second outer cross section of the heater component, thereby to prevent rotation of the heater component relative to the support, such that the support is configured to prevent the heater component from rotating within the aerosol provision device.

2. The aerosol provision device according to claim 1, wherein:

the first outer cross section is circular in shape; and the second outer cross section is non-circular in shape.

3. The aerosol provision device according to claim 1, wherein the second portion extends over less than about 15% of a length of the heater component.

4. The aerosol provision device according to claim 1, wherein: the second outer cross section is at least partially defined by one or more engagement features formed on an outer surface of the second portion; and the inner cross section is at least partially defined by one or more corresponding engagement features formed on an inner surface of the receptacle of the support.

5. The aerosol provision device according to claim 4, wherein:

the heater component comprises a plurality of engagement features formed on the outer surface of the second portion, wherein the engagement features are equally spaced around the outer surface; and the support comprises a plurality of corresponding engagement features formed on the inner surface of the receptacle of the support, wherein the corresponding engagement features are equally spaced around the inner surface.

6. The aerosol provision device according to claim 4, wherein:

the heater component defines a longitudinal axis, and the one or more engagement features have a dimension of less than about 1 mm measured in a direction perpendicular to the longitudinal axis; and the receptacle of the support defines an axis, and the one or more corresponding engagement features have a dimension less than about 1 mm measured in a direction perpendicular to the axis.

7. The aerosol provision device according to claim 4, wherein the receptacle of the support defines an axis and the one or more engagement features have a length of less than about 5 mm measured in a direction parallel to the axis.

8. The aerosol provision device according to claim 1, wherein the receptacle of the support has an inner cross section that is non-circular in shape.

9. The aerosol provision device according to claim 8, wherein the inner cross section is at least partially defined by one or more engagement features formed on an inner surface of the receptacle of the support.

10. The aerosol provision device according to claim 9, comprising a plurality of engagement features formed on the inner surface of the receptacle of the support, wherein the engagement features are equally spaced around the inner surface.

11. The aerosol provision device according to claim 9, wherein:

the receptacle of the support defines an axis and the one or more engagement features have a dimension less than about 1 mm measured in a direction perpendicular to the axis; and the receptacle of the support defines an axis the one or more engagement features have a length of less than about 5 mm measured in a direction parallel to the axis.

12. The aerosol provision device according to claim 1, wherein the receptacle of the support is keyed to prevent rotation of the heater component within the receptacle of the support.

13. A heater component for an aerosol provision device, comprising:

a first portion having a first outer cross section that is circular in shape; and a second portion having a second outer cross section that is non-circular in shape, wherein the heater component is hollow, such that the heater component defines a receptacle for an article comprising aerosol generating material to be inserted into, such that, in use, a user may insert the article into the receptacle of the heater component and remove the article from the receptacle of the heater component.

14. The heater component according to claim 13, wherein the second outer cross section is at least partially defined by one or more engagement features formed on an outer surface of the second portion.

15. The heater component according to claim 14, comprising a plurality of engagement features formed on the outer surface of the second portion, wherein the engagement features are equally spaced around the outer surface.

16. The heater component according to claim 14, wherein the heater component defines a longitudinal axis, and the one or more engagement features have a dimension of less than about 1 mm measured in a direction perpendicular to the longitudinal axis.

17. The heater component according to claim 13, wherein the second portion extends over less than about 15% of a length of the heater component.

18. The heater component according to claim 13, wherein the second portion extends along the heater component by less than about 5 mm.

19. A heater component for an aerosol provision device, wherein a portion of the heater component is keyed to prevent rotation of the heater component within a receptacle of the aerosol provision device, wherein the heater component is hollow, such that the heater component defines a receptacle for an article comprising aerosol generating material to be inserted into, such that, in use, a user may insert the article into the receptacle of the heater component and remove the article from the receptacle of the heater component.

20. The heater component according to claim 19, wherein the heater component is generally cylindrical.

* * * * *